United States Patent [19]

Lynches

[11] 4,332,019

[45] May 25, 1982

[54] ALARM CLOCK CONTROL

[76] Inventor: Michael T. Lynches, 34 Exeter St., Pittsburgh, Pa. 15217

[21] Appl. No.: 925,648

[22] Filed: Jul. 17, 1978

Related U.S. Application Data

[63] Continuation of Ser. No. 819,769, Jul. 28, 1977, abandoned.

[51] Int. Cl.[3] ..... G04B 21/00

[52] U.S. Cl. ..... 368/276; 368/12; 368/243; 368/250; 368/315

[58] Field of Search ..... 70/63, 289, 290, 313; 58/19 R, 16 R, 53–56, 57.5, 152 B; 368/12, 243, 250, 276, 315

[56] References Cited

U.S. PATENT DOCUMENTS

| | | | |
|---|---|---|---|
| 237,657 | 2/1881 | Zube | 70/289 |
| 430,815 | 6/1890 | Thomas | 70/289 |
| 900,293 | 10/1908 | Metz | 58/152 B |
| 924,127 | 6/1909 | Arms | 58/152 B |

*Primary Examiner*—Ulysses Weldon
*Attorney, Agent, or Firm*—William J. Ruano

[57] ABSTRACT

A delay device in combination with an alarm turn-off element for the purpose of requiring a delay period to turn off an alarm clock. The delay feature may take various forms and incorporate a puzzle requiring a period of concentration, a combination lock, the requirement of pushing a sequence of numbers, a dash pot, etc. The purpose is to prevent unconscious turning off of the alarm and falling asleep again.

1 Claim, 3 Drawing Figures

ALARM CLOCK CONTROL

This is a continuation of application Ser. No. 819,769, filed July 28, 1977, now abandoned.

This invention relates to alarm clocks and, more particularly, to the combination of such clock and means for delaying turning off of the alarm for a predetermined period of time.

In the past, when an alarm clock rang at a preset time, it has been possible to turn off the alarm with ease and to resume sleeping. While features been incorporated in the alarm to allow it to ring again after a short period of time, these have not been entirely satisfactory since they permit too long a delay in the period for rising.

An object of the invention, is to overcome the disadvantages of the aforesaid prior systems and to provide a novel alarm clock control which will delay the procedure of turning off the alarm and thereby require instant rising.

Other objects of the invention will become more apparent from a study of the following description taken with the accompanying drawing wherein.

Figure 1:
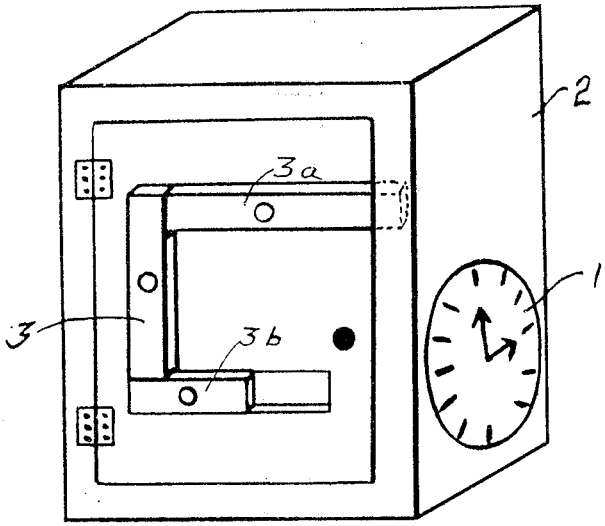
FIG. 1 is a perspective view of an alarm clock case embodying sliding puzzle keys as the delay means for opening thereof.

Referring to FIG. 1 of the drawing, numeral 1 denotes an alarm clock of any type, either mechanical or electrical, having the conventional "alarm on" element which when pulled out enables the alarm to ring at a preset time. It is entirely too easy a matter to turn off the alarm and fall back asleep for an unduly long time beyond the wishes of the sleeper.

According to the present invention, delay means are provided to prevent immediate success to the alarm clock by requiring either concentration effort by the awakened sleeper to insure that he is awakened or to provide a mechanical delay means which makes it impossible to immediately turn off the alarm switch.

Such delay means may take on various forms, for example, as shown in FIG. 1, it may comprise a case 2 for the alarm having a door which mounts a puzzle element 3 requiring concentration for putting the puzzle parts together in order to make it possible to open the door and shut off the alarm. Each of the puzzle elements or bars 3, 3*a*, and 3*b* has a central knob to grasp to enable sliding thereof in slots formed on the door arranged in right angular relationship. The upper bar 3*a* constitutes a locking element in the position shown. To open the door it is necessary to slide bar 3*b* to the right and bar 3 downwardly so that upper bar 3*a* may be slid to the left or unlocking position.

Figure 2:
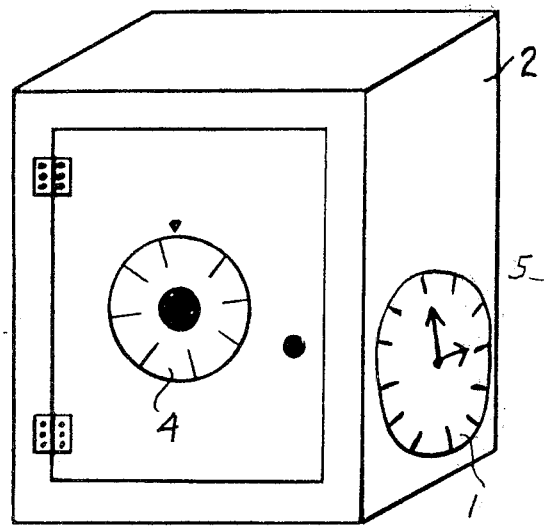
FIG. 2 is a perspective view of a modification comprising a combination lock.

FIG. 2 shows another modification of the delay means which involves the use of a combination lock 4 for locking the door of the clock requiring the sleeper to go through the process of remembering the combination of the lock in order to open the door and turn off the switch element.

Figure 3:
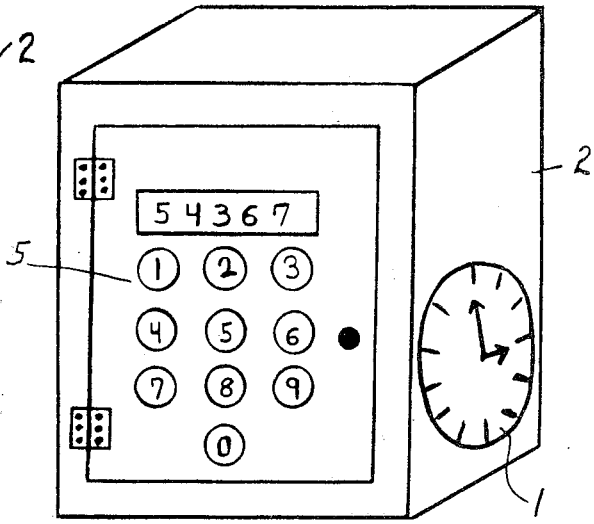
FIG. 3 is a further modification shown somewhat schematically wherein the selection of a series of numbers is required to open the case.

FIG. 3 shows a further modification which involves a digital flash device, that is, to require selection of a series of numbers to open the case of an electric clock.

Likewise, other kinds of delay means may be provided, such as dash pot to slow down the time period required for opening the door. Numerous other time delaying features may be used instead but all with the ultimate purpose of requiring concentration by the sleeper to assure that he is awake, or that will require a mehanical time delaying features to require a predetermined period to be awake before he is able to turn off the alarm.

While the delay features have been incorporated in the alarm clock case, they may instead, be incorporated in the alarm "on" or "off" switch itself to require a delay before turning off the switch.

Thus it will be seen that I have provided an efficient means for preventing immediate turn off of an alarm so that the sleeper will not be able to fall back asleep and be late for work or other appointments; furthermore, I have provided a specific delay means for turning off the alarm which requires concentration or awakedness to enable access to the alarm switch, also which is very simple and inexpensive to incorporate in a conventional alarm clock and which can be added as an auxiliary or supplementary unit.

While I have illustrated and described several embodiments of my invention, it will be understood that this is by way of illustration only and that various changes and modifications may be contemplated in my invention and within the scope of the following claims.

I claim:

1. An alarm clock, a case for closely surrounding said clock except its face and including a door having time delay means requiring a plurality of successive operations consuming appreciable time for delaying the period required for opening said door to turn the alarm to the alarm "off" position, said means comprising a puzzle element requiring concentration by the awakened sleeper for working out the puzzle, said puzzle element comprising three bars of uniform rectangular cross-section throughout their lengths longitudinally slideable in slots on said door and arranged in right angular relationship with one of the bars being slidable horizontally and constituting a locking element for said door by selectively being projected inwardly or outwardly relative to the perimeter of said door in consequence of given operations of said puzzle element, a vertically slidable bar having its bottom end resting against the top end of a second horizontal bar slidable in a horizontal slot of shorter length than its slot by at least the width of said vertically slidable bar.

* * * * *